United States Patent [19]

Nakamura et al.

[11] 4,185,054

[45] Jan. 22, 1980

[54] VARIABLE VENTURI TYPE CARBURETOR

[75] Inventors: Norihiko Nakamura, Mishima; Takaaki Itoh, Susono; Toshimi Misumi, Chita, Japan

[73] Assignees: Toyota Jidosha Kogyo Kabushiki Kaisha; Aisan Industry Co., Ltd., both of Aichi, Japan

[21] Appl. No.: 857,802

[22] Filed: Dec. 5, 1977

[30] Foreign Application Priority Data

Oct. 15, 1977 [JP] Japan ..... 52-123003

[51] Int. Cl.[2] ..... F02M 9/06

[52] U.S. Cl. ..... 261/44 C; 137/604; 261/DIG. 56

[58] Field of Search ..... 261/44 B, 44 C, DIG. 56; 137/604

[56] References Cited

U.S. PATENT DOCUMENTS

| | | | |
|---|---|---|---|
| 1,375,898 | 4/1921 | Ciglia et al. | 261/44 B |
| 1,634,461 | 7/1927 | Grikscheit | 261/44 C |
| 3,329,413 | 7/1967 | Pate | 261/44 C |
| 4,013,741 | 3/1977 | Edmonston | 261/44 B |

FOREIGN PATENT DOCUMENTS

| | | | |
|---|---|---|---|
| 559635 | 9/1923 | France | 261/44 B |
| 45-5482 | 3/1966 | Japan | 261/44 C |
| 213307 | 3/1924 | United Kingdom | 261/44 B |

*Primary Examiner*—Tim R. Miles

*Attorney, Agent, or Firm*—Stevens, Davis, Miller & Mosher

[57] ABSTRACT

Disclosed is a variable venturi type carburetor which is provided with a suction piston movable in a direction perpendicular to an air flow, in accordance with changes in the air flow, so as to vary the area of a venturi opening formed between the bottom end of the suction piston and a wall of the carburetor body facing the bottom end of the suction piston, for maintaining the speed of the air flow passing through the venturi opening substantially constant. The suction piston has a hole formed therein communicating the venturi opening with a suction chamber in which the suction piston is moved. The carburetor has a spring for urging the suction piston, but does not have any oil damper within the suction chamber. The shape of the venturi opening is so arranged that the increase of the area of the venturi opening in accordance with the displacement of the suction piston is gradually increased. As a result, fluctuation due to the resonance and wide fluctuation caused during the transient response of the suction piston do not occur.

6 Claims, 11 Drawing Figures

Fig. 6
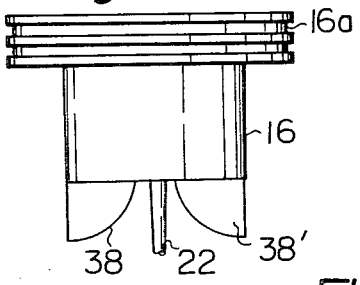
Fig. 7
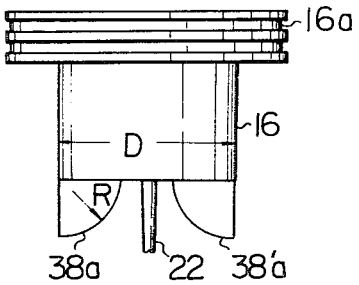
Fig. 8
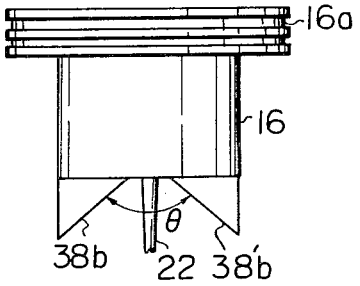
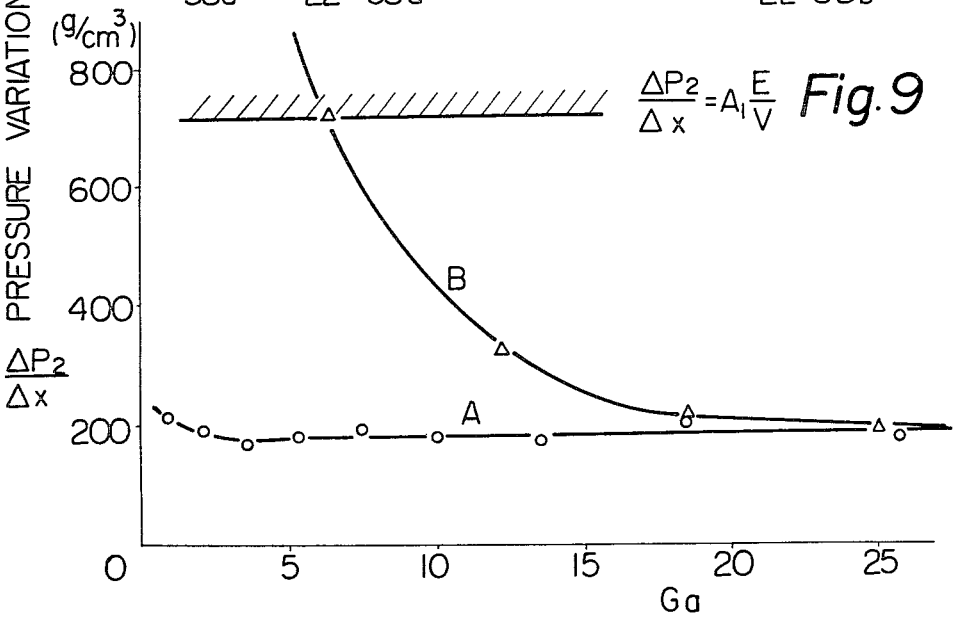
Fig. 9

VARIABLE VENTURI TYPE CARBURETOR

BRIEF DESCRIPTION OF THE INVENTION

This invention relates to a variable venturi type carburetor, especially to a variable venturi type carburetor which is not provided with any oil damper within a suction piston thereof.

From the point of view of reducing harmful contaminants, such as carbon monoxide (CO), hydrocarbon (HC) and nitrogen oxides ($NO_x$), contained in exhaust gas emitted from an internal combustion engine mounted in a vehicle and reducing fuel consumption of the engine, the importance of the operating characteristics of a carburetor is increasing.

BACKGROUND OF THE INVENTION

Known carburetors are classified into two types, a fixed venturi type and a variable venturi type. Variable venturi type carburetors have been mainly mounted on a specially designed car such as a sports car. Variable venturi type carburetors have the advantages of: (a) good transient response which takes place when the supply of the mixture is changed, and; (b) good continuity of operating characteristics between the idling condition and the running condition of the engine, because the variable venturi type carburetors are not divided into a slow system and a main system. Consequently, to reduce harmful contaminants in exhaust gas, reduce fuel consumption of an engine and increase the driveability of a vehicle, variable venturi type carburetors are also utilized in regular type automobiles.

As is well known in the art, a variable venturi type carburetor is provided with a suction piston movable in a direction perpendicular to an air flow, in accordance with changes in the air flow, so as to vary the area of venturi opening formed between the bottom end of the suction piston and the wall of the carburetor body facing the bottom end of the suction piston, for maintaining the speed of the air flow passing through the venturi opening substantially constant. However, in a conventional variable venturi type carburetor, a suction piston may cause a vertical oscillation due to the slow oscillation of the intake vacuum of the engine when the engine is operated at low speed. In addition, when the throttle valve disposed in the carburetor is opened suddenly (when the engine is increasingly accelerated), the suction piston may suddenly displace upward and may fluctuate widely on both sides of the predetermined position, and as a result, the air fuel ratio may become lean.

To obviate the above-mentioned problems, a conventional variable carburetor has an oil damper installed within a piston rod for guiding the suction piston. However, the oil stored in the oil damper of the variable venturi type carburetor may be lost with the passage of time during which the variable venturi type carburetor is used. If damping oil is not supplied adequately, the carburetor may cause a wide fluctuation of the suction piston or a slow oscillation of the suction piston as a variable venturi type carburetor having no oil damper disposed therein does. As a result, the operating characteristics of a vehicle, such as the acceleration ability and driveability, are degraded.

The viscosity of damping oil stored in the oil damper must be adequately adjusted. If damping oil having a high viscosity is used, the suction piston is prevented from quick movement. As a result, the air fuel ratio is enriched, harmful contaminants contained in exhaust gas are increased and fuel consumption is increased. On the other hand, if damping oil having a low viscosity is used, the damping effect of the oil damper is decreased. In addition, it should be noted that the viscosity of oil varies as ambient temperature is varied. Therefore, in summer, the problem caused by using oil having a low viscosity may occur, and in winter, the problem caused by using oil having a high viscosity may occur. As is apparent from the above discussion, an oil damper is troublesome because it requires the maintenance and adjustment of the quality and quantity of oil at a predetermined level.

SUMMARY OF THE INVENTION

The principle object of the present invention is to provide a variable venturi type carburetor which can obviate the above-mentioned problems associated with an oil damper installed in the variable venturi type carburetor.

Another object of the present invention is to provide a variable venturi type carburetor which has a specially shaped venturi opening instead of a rectangular venturi opening of a conventional variable venturi carburetor and which can prevent fluctuation due to resonance and wide fluctuation from occurring without using an oil damper disposed therein.

A further object of the present invention is to provide a variable venturi type carburetor which can be easily maintained.

Other features and advantages of the present invention will become apparent from the description set forth below with reference to the accompanying drawings.

BRIEF DESCRIPTION OF THE DRAWINGS

FIG. 6 is a side view which shows a suction piston installed in the apparatus shown in FIG. 4;

FIG. 7 is a side view which shows a suction piston of a second embodiment according to the present invention;

FIG. 8 is a side view which shows a suction piston of a third embodiment according to the present invention;

FIG. 9 is a diagram which shows the relationships between the air flow Ga and the pressure variation $\Delta P_2/\Delta x$ of a conventional carburetor and of the apparatus shown in FIGS. 4 through 6, and;

DETAILED DESCRIPTION OF THE INVENTION

Principle of the Present Invention

Prior to the explanation of embodiments according to the present invention, the theoretical background of the present invention will be explained. A variable venturi type carburetor has a suction piston movably disposed within a suction chamber. The suction piston has a hole therein for communicating the venturi opening with the inside of the suction chamber and the suction chamber has a spring disposed therein for urging the suction piston. Therefore, the variable venturi type carburetor is divided into two models, which are, (1) a pneumatic system model shown in FIG. 1 and (2) a spring system model shown in FIG. 2.

Figure 1:
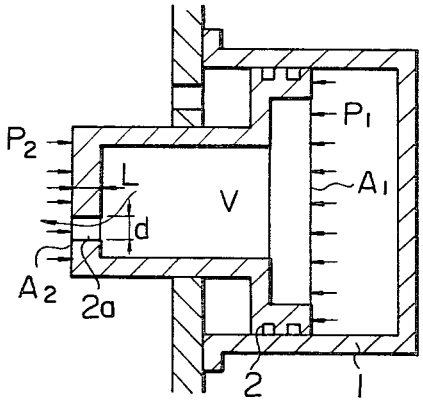
FIGS. 1 and 2 are schematic illustrations which are used for the explanation of the present invention.

(1) Pneumatic System Model (FIG. 1)

Pressure acting on a suction piston 2 installed in a suction chamber 1 is designated by $P_1$, the cross sectional area of the suction piston 2 is designated by $A_1$, pressure acting on the surface, facing the venturi opening, of the suction piston 2 is designated by $P_2$ and the cross sectional area of the suction piston is designated by $A_2$. When the forces acting on the suction piston 2 are balanced, the pressures $P_1$ and $P_2$ acting on the suction piston 2 are equal to each other and $P_1$ equals $P_2$. When the suction piston 2 is displaced a small distance $\Delta x$ from the balanced condition by an external force, the variations of the pressures $P_1$ and $P_2$ may be designated as $\Delta P_1$ and $\Delta P_2$, and the following equation of the balanced force obtained $$\Delta P_2 = \Delta P_1 + \Delta P_r + \Delta P_f \quad (1)$$

wherein, $\Delta P_r$ designates the variation of the pressure caused by the viscosity of air passing through the hole, and is expressed as $$\Delta P_r = 128\ \mu L/\pi d^4\ Q,$$

and;

$\Delta P_f$ designates the variation of the pressure caused by the force of inertia of air passing through the hole, and is expressed as $$\Delta P_f = 4L\rho/\pi d^4 \cdot dQ/dt$$

wherein,

Q designates an air flow passing through the hole, and is expressed as $$Q = V/E \cdot dP_1/dt - A_1 dx/dt;$$

$\mu$ designates the coefficient of viscosity of air;
$\rho$ designates the density of air;
L designates the length of the hole;
d designates the diameter of the hole;
V designates the volume of the suction chamber, and;
E designates the bulk modulus of air.

The force f acting on the suction piston 2 is expressed by the following equation.

$$f = A_2 P_2 - A_1 P_1 \quad (2)$$

According to the required operating characteristics of the variable venturi carburetor, the pressure variation $\Delta P_2$ at the venturi opening is expressed by the following equation when the suction piston 2 is displaced a small distance $\Delta x$ from the balanced condition.

$$\Delta P_2/\Delta x = C \quad (3)$$

wherein, C is constant.

Figure 2:
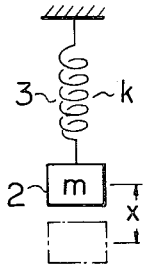

(2) Spring System Model (FIG. 2)

The equation of motion concerning the spring system model shown in FIG. 2 is expressed by the following equation, wherein m is the mass of the suction piston 2 and k is the coefficient of the spring 3, but the damped factor is neglected.

$$f = m\ d^2x/dt^2 + kx \quad (4)$$

To study the stability of the variable venturi carburetor, a characteristic equation is established using the above-mentioned equations (1) through (4), and a criterion of the stability of the variable venturi carburetor is obtained, which is given by the following equation.

$$A_1 E/V > \Delta P_2/\Delta x \quad (5)$$

(When an equation $\Delta P_1 = E/VA_1 \cdot \Delta x$, which expresses the increase of the pressure due to the compression of gas, is substituted into equation (5), the following equation (6) is obtained.

$$\Delta P_1/\Delta x > \Delta P_2/\Delta x \quad (6)$$

It will be understood from the equation (5) that, when the ratio between the pressure variation $\Delta P_2$ of the pressure $P_2$ at the venturi opening and the small displacement $\Delta x$ of the suction piston 2 is selected to be smaller than a predetermined value which is given by the equation (5), the fluctuation of the suction piston due to resonance can be prevented from occurring. In addition, when the operating characteristics of the variable venturi type carburetor are taken into consideration, it can be concluded that the variation $\Delta S$ of the cross sectional area S of the venturi opening due to the small displacement $\Delta x$ of the suction piston should be small.

Consequently, when a conventional variable venturi carburetor which has a rectangular venturi opening is used to satisfy the above-mentioned criterion, the venturi opening should be shaped into a slender rectangle having its long sides along the displacing direction of the suction piston. This will result in the variation of the cross sectional area of the venturi opening due to the small displacement $\Delta x$ of the suction piston being small. However, such a variable venturi carburetor which has a slender rectangular venturi opening must have a large suction piston stroke, so that the maximum air flow, which is determined by the required performance of the carburetor, is supplied through the venturi opening. As a result, such variable venturi carburetor can not be actually used.

Figure 3:
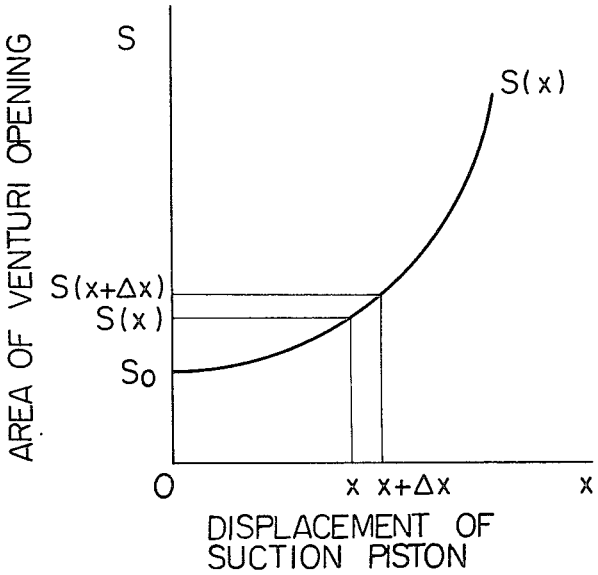
FIG. 3 is a diagram which shows the relationship between the displacement of the suction piston and the area of the venturi opening in a variable venturi carburetor according to the present invention.

The inventors of the present invention have conducted research to find a shape of the venturi opening which can satisfy the above-mentioned criterion and provide a sufficiently large maximum air flow, and which can be actually used in a variable venturi carburetor. Referring to FIG. 3, a displacement of the suction piston is designated by x, and the area of the venturi opening corresponding to the displacement x is designated by S(x). When the suction piston is displaced a small distance $\Delta x$ and the variation ratio is a constant $\alpha$, the condition is given by the following equation (7).

$$[S(x+\Delta x) - S(x)]/S(x) = \alpha \quad (7)$$

The integral of the equation (7) is $$S=S_o e^{\alpha x} \quad (8)$$

wherein, $S_o$ is the area of the venturi opening at $x=0$.

The side shape f(x) of the venturi opening is obtained when the equation (8) is differentiated.

$$f(x)=\alpha S_o e^{\alpha x} \quad (9)$$

It is concluded, in view of the above discussion, that when the end surface of the venturi opening is formed in an exponential curve of the displacement of the suction piston, the pressure variation $\Delta P_2$ at the venturi opening can be maintained lower than a predetermined value. Consequently, fluctuation of the suction piston due to resonance can be prevented from occurring and a sufficiently large cross sectional area of the venturi opening can be obtained.

Embodiment

An embodiment of the present invention in accordance with the above discussion will now be explained with reference to FIGS. 4 through 6.

A carburetor body 10 is provided with a chamber case 12 and a suction chamber 14 is formed within the chamber case 12. The chamber case 12 has a guide 13 formed therein in one body. The guide 13 has a rod 18 movably inserted therein and the rod 18 is fixed to a suction piston 16. The suction piston 16 is held by the chamber case 12, so that the suction piston 16 can move within the chamber case 12, and the suction piston 16 has labyrinth packings **16*a* formed thereon. The wall of the suction piston 16, which wall faces to a venturi opening 28, has a hole 16*b* formed therein. The upper wall of the carburetor body 10 has a hole 10*a* formed therein, which hole 10*a* communicates the inside of the carburetor body 10 with an atmospheric pressure chamber 20 formed at a space between the suction piston 16 and the carburetor body 10. A metering rod 22 is fixed to the bottom end of the suction piston 16 so that the metering rod 22 can be inserted into a well 24 connected to the lower wall of the carburetor body 10. Fuel supplied to the well 24 through an inlet pipe 27 is measured and supplied into the venturi opening 28 through a clearance formed between the metering rod 22 and a metering jet 26 formed at an inlet of the well 24. A throttle valve 30 is disposed at a position downstream of the venturi opening 28 and an air horn 32 for supplying air is disposed at a position upstream of the venturi opening 28. The suction chamber 14 has a spring 34 therein for urging the suction piston 16**.

The construction mentioned above is similar to that of a conventional variable venturi type carburetor. The variable venturi type carburetor according to the present invention shown in FIGS. 4 through 6 has a flat projection 36 formed on the lower wall of the carburetor body 10, and also, has a pair of partitions 38 and 38' fixed to the bottom end of the suction piston 16. The end surface f(x) of each partition 38 or 38' is formed in an exponential curve $f(x)=\alpha S_o e^{\alpha x}$ at a distance x measured from the bottom end. As a result, the area of the venturi opening 28, which is formed by the bottom end of the suction piston 16, the projection 36 formed on the carburetor body 10 and the pair of partitions 38 and 38', is also an exponential function of the distance x. The variation ratio $\Delta S/S$ is constant when the ratio is defined by the area variation $\Delta S$ of the venturi opening in accordance with the small displacement $\Delta x$ to the area S of the venturi opening.

If the throttle valve 30 is suddenly opened while the suction piston 16 has had a predetermined displacement in accordance with the air flow passing through the venturi opening 28, so that the forces acting on the suction piston 16 due to the pressure and the spring 34 have been balanced, the vacuum pressure $P_2$ in the venturi opening 28 is raised. The raised vacuum pressure $P_2$ is transmitted into the suction chamber 14 through the hole **16*b*. As a result, the force acting in the atmospheric pressure chamber 20 and that acting in the suction chamber 14 become unbalanced, and the suction piston 16 begins to displace upward against the urging force of the spring 34. When the suction piston 16 begins to displace upward, the vacuum pressure in the venturi opening is lowered and a force acting on the bottom end of the suction piston 16, for raising the suction piston 16, is generated. On the other hand, the air in the suction chamber 14 is compressed when the suction piston 16 is raised and the suction piston 16** is forced back due to the air cushion effect.

Figure 4:
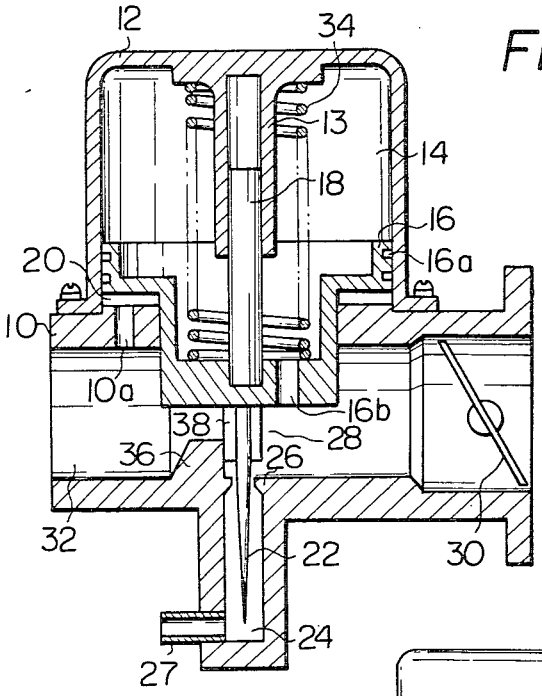
FIG. 4 is a sectioned elevational view which shows a first embodiment of the present invention.

The area of the venturi opening 28 is so selected that the variable venturi carburetor can satisfy the equation (6), that is $(\Delta P_1/\Delta x)>\Delta P_2/\Delta x$, and as is apparent from FIG. 4, $A_1>A_2$. The force acting on the suction piston 16 due to the pressure increase $\Delta P_2$ when the suction piston 16 is raised upward is equal to $\Delta P_2 \times A_2$. The force acting on the suction piston 16 due to the air cushion effect of the suction chamber 14 caused by the displacement of the suction piston 16 is equal to $\Delta P_1 \times A_1$. Consequently, the force acting on the suction piston due to the air cushion effect $\Delta P_1 \times A_1$ is larger than that due to the pressure increase $\Delta P_2 \times A_2$. Therefore, the suction piston 16 does not generate the fluctuation due to resonance and wide fluctuation.

Figure 5:
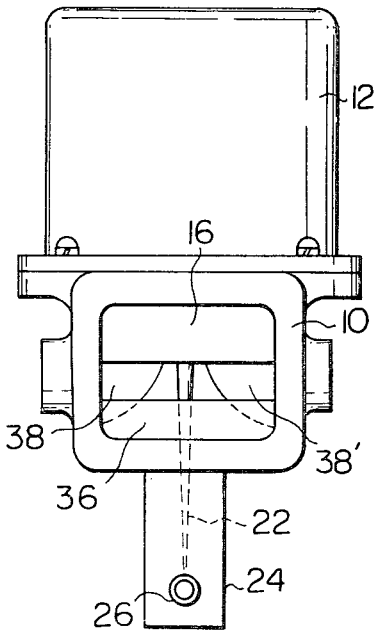
FIG. 5 is a side view of the apparatus shown in FIG. 4.

The test data obtained by the variable venturi type carburetor according to the present invention shown in FIGS. 4 through 6 (in which, the constants expressed in the equation (9) are selected to be $0.1 \leqq \alpha \leqq 0.3$, $1.0 \leqq S_o \leqq 60$ ($mm^2$)) and by that of a conventional type having a slender venturi opening (the width of which is not less than 8 mm) and no oil damper disposed therein are illustrated in FIG. 9. In FIG. 9, the data are plotted on a graph with the air flow in weight Ga g/s as the ordinate and the pressure variation $\Delta P_2/\Delta x$, defined by the ratio of the pressure increase $\Delta P_2$ to the small displacement $\Delta x$ of the suction piston, as the abscissa. The curve A shows the operating characteristics of the present invention. From the curve A it is seen that the pressure variation $\Delta P_2/\Delta x$ is almost constant for all the air flow Ga. Fluctuation of the suction piston 16 could not be observed. On the other hand, the curve B shows the operating characteristics of the conventional carburetor. From the curve B, it is seen that the pressure variation $\Delta P_2/\Delta X$ is steeply increased at the closed position of the suction piston where the air flow Ga is small. Fluctuation of the suction piston was observed. This fluctuation is caused by the fact that the pressure variation $\Delta P_2/\Delta x$ exists within a range which is above the limit of the fluctuation expressed by $\Delta P_2/\Delta x=A_1E/V$.

The variable venturi type carburetor shown in FIGS. 4 through 6 can prevent the fluctuation of the suction piston without using an oil damper which causes various problems.

The suction piston 16 shown in FIG. 7 is provided with a pair of partitions **38*a* and 38'*a*, each of which has an end surface of an arc shape instead of those of 38 and 38′ of the exponential curve. It is easier to manufacture the partition 38***a* or 38′*a* than the partition 38 or 38′. The suction piston 16 shown in FIG. 8 is provided with a pair of partitions 38*b* and 38′*b*, each of which has an inclined end surface. It is easier to manufacture the partition 38*b* and 38′*b* than the partitions 38 and 38′. It has been confirmed by tests that, when the suction piston shown in FIGS. 7 and 8 are so designed that the pressure variation $\Delta P_2/\Delta x$ is smaller than the limit of the fluctuation $A_1E/V$, the fluctuation of the suction piston due to resonance and wide fluctuation can be prevented. (Tests were effected for the suction piston shown in FIG. 7 in a range of $R/3 \leqq R \leqq D$, $10 \leqq S_o \leqq 60$ ($mm^2$), and for the suction piston shown in FIG. 8 in a range of $80° \leqq \theta \leqq 140°$, $10 \leqq S_o \leqq 60$ ($mm^2$)).

Figure 10:
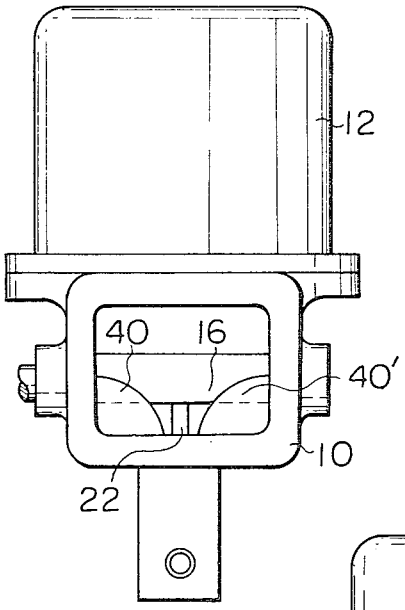
FIGS. 10 and 11 are side views, each of which shows a suction piston of a fourth or fifth embodiment according to the present invention.
Figure 11:
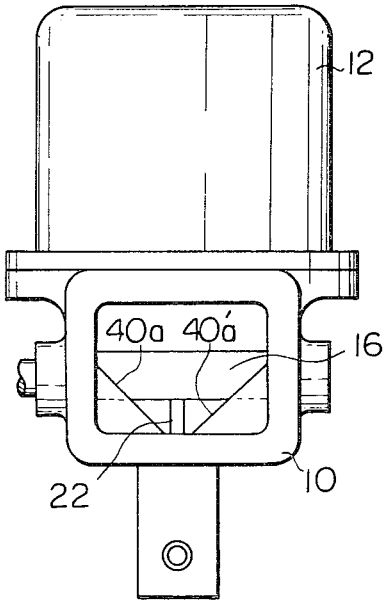

A variable venturi carburetor shown in FIG. 10 comprises a suction piston 16 having a flat bottom end and a pair of partitions 40 and 40′ disposed on a wall of a carburetor body 10 facing the bottom end of the suction piston 16. The end surface of each partition is formed in an exponential curve $f(x)=\alpha S_o e^{\alpha x}$ at a distance measured from the wall of the carburetor body 10. The ends surfaces are so disposed that each end surface is opposite the other end surface. The variable venturi type carburetor shown in FIG. 10 does not cause fluctuation of the suction piston. The end surface of the partition 40 or 40′ shown in FIG. 10 can also be formed in an arc shape similar to that shown in FIG. 7, and can be formed in an inclined shape (shown in FIG. 11) similar to that shown in FIG. 8.

The present invention can prevent fluctuation due to resonance and wide fluctuation of the suction piston without an oil damper being disposed in a carburetor, and the variable venturi type carburetor is simple in construction and is easy to maintain and adjust.

What we claim is:

1. A variable venturi type carburetor provided with a suction piston movable in a direction perpendicular to an air flow, in accordance with changes in said air flow, so as to vary the area of a venturi opening formed between the bottom end of said suction piston and the wall of the carburetor body facing said bottom end of said suction piston, for maintaining the speed of said air flow passing through said venturi opening substantially constant, said suction piston having a hole formed therein communicating said venturi opening with a suction chamber in which said suction piston is movable, said bottom end of said suction piston being provided with a pair of partitions, the end surface of each partition being formed in an exponential curve at a distance measured from said bottom end, said pair of partitions being so disposed that said end surfaces thereof are opposite to each other, said carburetor being provided with a spring disposed in a space between said suction chamber and said suction piston for urging said suction piston, but not with oil damper means, and wherein the shape of said venturi opening is so arranged that the pressure increase $\Delta P_2$ at said venturi opening in accordance with the displacement $\Delta X$ of said suction piston satisfies the equation $$A_1(E/V) > \Delta P_2/\Delta X$$

wherein $A_1$ is the cross-sectional area, facing said suction chamber, of said suction piston, E is the bulk modulus of air, and V is the volume of said suction chamber.

2. A variable venturi type carburetor provided with a suction piston movable in a direction perpendicular to an air flow, in accordance with changes in said air flow, so as to vary the area of a venturi opening formed between the bottom end of said suction piston and the wall of the carburetor body facing said bottom end of said suction piston, for maintaining the speed of said air flow passing through said venturi opening substantially constant, said suction piston having a hole formed therein communicating said venturi opening with a suction chamber in which said suction piston is movable, said bottom end of said suction piston being provided with a pair of partitions, the end surface of each partition having an arc shape, said pair of partitions being so disposed that said end surfaces thereof are opposite to each other, said carburetor being provided with a spring disposed in a space between said suction chamber and said suction piston for urging said suction piston, but not with oil damper means, and wherein the shape of said venturi opening is so arranged that the pressure increase $\Delta P_2$ at said venturi opening in accordance with the displacement $\Delta X$ of said suction piston satisfies the equation $$A_1(E/V) > \Delta P_2/\Delta X$$

wherein $A_1$ is the cross-sectional area, facing said suction chamber, of said suction piston, E is the bulk modulus of air, and V is the volume of said suction chamber.

3. A variable venturi type carburetor provided with a suction piston movable in a direction perpendicular to an air flow, in accordance with changes in said air flow, so as to vary the area of a venturi opening formed between the bottom end of said suction piston and the wall of the carburetor body facing said bottom end of said suction piston, for maintaining the speed of said air flow passing through said venturi opening substantially constant, said suction piston having a hole formed therein communicating said venturi opening with a suction chamber in which said suction piston is movable, said bottom end of said suction piston being provided with a pair of partitions, each partition having an inclined end surface, said pair of partitions being so disposed that said end surfaces thereof are opposite to each other, said carburetor being provided with a spring disposed in a space between said suction chamber and said suction piston for urging said suction piston, but not with oil damper means, and wherein the shape of said venturi opening is so arranged that the pressure increase $\Delta P_2$ at said venturi opening in accordance with the displacement $\Delta X$ of said suction piston satisfies the equation $$A_1(E/V) > (\Delta P_2/\Delta X)$$

wherein $A_1$ is the cross-sectional area, facing said suction chamber, of said suction piston, E is the bulk modulus of air, and V is the volume of said suction chamber.

4. A variable venturi type carburetor provided with a suction piston movable in a direction perpendicular to an air flow, in accordance with changes in said air flow, so as to vary the area of a venturi opening formed between the bottom end of said suction piston and the wall of the carburetor body facing said bottom end of said suction piston, for maintaining the speed of said air flow passing through said venturi opening substantially constant, said suction piston having a hole formed therein communicating said venturi opening with a suction chamber in which said suction piston is movable, said bottom end of said suction piston being flat and said wall of said carburetor body facing said bottom end being provided with a pair of partitions, the end surface of each partition being formed in an exponential curve at a distance measured from said wall, said pair of partitions being so disposed that said end surfaces thereof are opposite to each other, said carburetor being provided with a spring disposed in a space between said suction chamber and said suction piston for urging said suction piston, but not with oil damper means, and wherein the shape of said venturi opening is so arranged that the pressure increase $\Delta P_2$ at said venturi opening in accordance with the displacement $\Delta X$ of said suction piston satisfies the equation $$A_1(E/V) > (\Delta P_2/\Delta X$$

wherein $A_1$ is the cross-sectional area, facing said suction chamber, of said suction piston, E is the bulk modulus of air, and V is the volume of said suction chamber.

5. A variable venturi type carburetor provided with a suction piston movable in a direction perpendicular to an air flow, in accordance with changes in said air flow, so as to vary the area of a venturi opening formed between the bottom end of said suction piston and the wall of the carburetor body facing said bottom end of said suction piston, for maintaining the speed of said air flow passing through said venturi opening substantially constant, said suction piston having a hole formed therein communicating said venturi opening with a suction chamber in which said suction piston is movable, said bottom end of said suction piston being flat and said wall of said carburetor body facing said bottom end being provided with a pair of partitions, the end surface of each partition having an arc shape, said pair of partitions being so disposed that said end surfaces thereof are opposite to each other, said carburetor being provided with a spring disposed in a space between said suction chamber and said suction piston for urging said suction piston, but not with oil damper means, and wherein the shape of said venturi opening is so arranged that the pressure increase $\Delta P_2$ at said venturi opening in accordance with the displacement $\Delta X$ of said suction piston satisfies the equation $$A_1(E/V) > \Delta P_2/\Delta X$$

wherein $A_1$ is the cross-sectional area, facing said suction chamber, of said suction piston, E is the bulk modulus of air, and V is the volume of said suction chamber.

6. A variable venturi type carburetor provided with a suction piston movable in a direction perpendicular to an air flow, in accordance with changes in said air flow, so as to vary the area of a venturi opening formed between the bottom end of said suction piston and the wall of the carburetor body facing said bottom end of said suction piston, for maintaining the speed of said air flow passing through said venturi opening substantially constant, said suction piston having a hole formed therein communicating said venturi opening with a suction chamber in which said suction piston is movable, said bottom end of said suction piston being flat and said wall of said carburetor body facing said bottom end being provided with a pair of partitions, each partition having an inclined end surface, said pair of partitions being so disposed that said inclined end surfaces thereof are opposite to each other, said carburetor being provided with a spring disposed in a space between said suction chamber and said suction piston for urging said suction piston, but not with oil damper means, and wherein the shape of said venturi opening is so arranged that the pressure increase $\Delta P_2$ at said venturi opening in accordance with the displacement $\Delta X$ of said suction piston satisfies the equation $$A_1(E/V) > (\Delta P_2/\Delta X)$$

wherein $A_1$ is the cross-sectional area, facing said suction chamber, of said suction piston, E is the bulk modulus of air, and V is the volume of said suction chamber.

* * * * *